US009642757B2

(12) United States Patent
Sheppard

(10) Patent No.: US 9,642,757 B2
(45) Date of Patent: May 9, 2017

(54) TILT MOTION LEISURE ADJUSTABLE BED BASE

(71) Applicant: Bruce Alan Sheppard, Cathedral City, CA (US)

(72) Inventor: Bruce Alan Sheppard, Cathedral City, CA (US)

( * ) Notice: Subject to any disclaimer, the term of this patent is extended or adjusted under 35 U.S.C. 154(b) by 799 days.

(21) Appl. No.: 13/961,833

(22) Filed: Aug. 7, 2013

(65) Prior Publication Data

US 2015/0040317 A1 Feb. 12, 2015

Related U.S. Application Data

(60) Provisional application No. 61/796,764, filed on Jan. 16, 2013.

(51) Int. Cl.

| | |
|---|---|
| ***A61G 7/015*** | (2006.01) |
| ***A61G 7/005*** | (2006.01) |
| ***A61G 7/018*** | (2006.01) |
| ***A47C 20/04*** | (2006.01) |
| ***A47C 19/04*** | (2006.01) |
| *A61G 7/05* | (2006.01) |

(52) U.S. Cl.

CPC ..... *A61G 7/015* (2013.01); *A47C 19/045* (2013.01); *A47C 20/041* (2013.01); *A61G 7/005* (2013.01); *A61G 7/018* (2013.01); *A61G 7/0506* (2013.01); *A61G 2203/12* (2013.01)

(58) Field of Classification Search

CPC ..... A47C 20/04; A47C 20/041; A47C 20/08; A61G 7/002; A61G 7/005; A61G 7/012; A61G 7/015; A61G 7/018; A61G 13/02; A61G 13/04; A61G 13/06; A61G 13/08; A61G 2203/12

USPC ..... 5/611, 610, 600, 613, 616–618

See application file for complete search history.

(56) References Cited

U.S. PATENT DOCUMENTS

| | | | | | |
|---|---|---|---|---|---|
| 2,687,536 | A * | 8/1954 | Miller | A61G 7/002 | 137/614.11 |
| 3,149,349 | A * | 9/1964 | Nelson | A61G 7/015 | 5/610 |
| 3,262,133 | A * | 7/1966 | Beitzel | A61G 7/00 | 5/429 |
| 3,593,350 | A * | 7/1971 | Knight | A47C 20/08 | 5/616 |
| 4,227,269 | A * | 10/1980 | Johnston | A61G 7/002 | 5/611 |

(Continued)

*Primary Examiner* — Robert G Santos

(74) *Attorney, Agent, or Firm* — Charles C. H. Wu; Charles C. H. Wu & Associates, APC

(57) ABSTRACT

An adjustable bed base adaptable to tilt in a number of different comfortable positions is presented. The adjustable bed base comprises a bed frame, a deck, a plurality of supporting legs, a plurality of lateral leg supporting members, a left elongated structure, a right elongated structure, a mattress retainer bar, a sliding member, a frame reinforcement bar, a control box, a power supply module, a remote control, a backrest motor, a footrest motor, a plurality of levers and a tilt arm assembly. The tilt arm assembly includes at least one motor claw, a sliding member and at least one bed tilt motor. The backrest motor, the footrest motor and the at least one bed tilt motor receives at least one operating signal transmitted by the remote control and tilts the adjustable bed base in the plurality of comfortable positions.

59 Claims, 9 Drawing Sheets

(56) References Cited

U.S. PATENT DOCUMENTS

| | | | | | |
|---|---|---|---|---|---|
| 4,435,862 | A * | 3/1984 | King | A61G 7/015 | 318/467 |
| 5,161,274 | A * | 11/1992 | Hayes | A47C 20/041 | 5/616 |
| 5,205,004 | A * | 4/1993 | Hayes | A61G 7/015 | 5/611 |
| 6,276,011 | B1 * | 8/2001 | Antinori | A47C 20/041 | 5/613 |
| 2013/0019407 | A1 * | 1/2013 | Sheppard | A47C 20/041 | 5/611 |
| 2015/0040317 | A1 * | 2/2015 | Sheppard | A61G 7/015 | 5/611 |

* cited by examiner

TILT MOTION LEISURE ADJUSTABLE BED BASE

CROSS-REFERENCE TO RELATED APPLICATION

This application claims the benefit of U.S. Provisional Application No. 61/796,764 filed on Jan. 16, 2013.

BACKGROUND OF THE INVENTION

1. Technical Field of the Invention

The present embodiment relates in general to adjustable beds. More specifically, the present embodiment provides an adjustable tilting bed base adaptable to tilt in a number of different, comfortable positions automatically and possesses an aesthetic and stylish appearance.

2. Description of the Related Art

A wide variety of adjustable beds have been developed in the art. The adjustable beds are adaptable to change into a number of comfortable positions. The adjustable beds are commonly used in hospitals, rehabilitation centers and for in-home use. It is very difficult for the patients who have undergone major surgeries like knee surgery and orthopedic surgeries to get out of bed comfortably. The adjustable beds help these patients to relocate to and from their beds more easily. Also, these adjustable beds assist the patient to lie in different comfortable positions. The adjustable beds are very helpful for patients suffering from sleep disorders like sleep apnea. It is advisable for these patients to keep their head in a raised position while sleeping. The adjustable beds allow them to keep their heads comfortably in a raised position than their feet.

Adjustable beds are now viewed as part of a home's décor also. These adjustable beds are more aesthetic and stylish in appearance than the traditional adjustable beds used in hospitals or medical facilities. These stylish adjustable beds also provide the same great comfort and relaxation as the traditional adjustable beds. A user can watch television, read books, browse internet and perform similar leisure time activities while lying on these beds. It is very easy to change the settings for the adjustable beds to convert from one comfortable position to another. This enables a person to change from a sitting position to a lying position with little or no effort.

Existing conventional adjustable beds have considerable drawbacks. For example, in an existing device, an adjustable bed comprises a frame, an adjusting mechanism, a deck, and a foot support. The adjusting mechanism is movable between a horizontal position and a vertical position. The foot support is fixedly mounted to the adjusting mechanism. Even so, this adjustable bed assembly allows only two adjustable positions for a patient and there is no provision to adjust the headrest portion and the footrest portion of the adjustable bed. So this adjustable bed is not suitable for patients suffering from sleep apnea. Thus existing adjustable bed bases are only capable of being adjusted to a limited number of positions.

Hence, it can be seen, that there is a need for a device that would be simple in construction and highly reliable. Such a device would allow the patient to change the bed position automatically without the need of an additional care giver. Further, such a needed device would be adaptable to get tilted in a multiple number of positions like backrest tilting, footrest tilting, bed lifting etc. Such a needed device would be designed to tilt in a desired angle and height. Moreover, such a needed device would have an aesthetic appearance and would be utilized as a home decor.

SUMMARY OF THE INVENTION

To minimize the limitations found in the prior art, and to minimize other limitations that will be apparent upon the reading of the specifications, the present invention is an adjustable bed base adaptable to move in a number of different comfortable positions. The adjustable bed base generally comprises a bed frame having a left side, a right side, a head end, a foot end, a top frame portion, a bottom frame portion and a plurality of bed corners. A deck is positioned over the bed frame for supporting a mattress. The deck includes a backrest, a footrest and a plurality of middle portions. The adjustable bed base further comprises a mattress retainer bar to prevent the mattress from sliding off the deck when the adjustable bed base moves in the different comfortable positions.

The bottom frame portion includes a plurality of supporting legs, a left elongated structure and a right elongated structure. The left and the right elongated structures include a track portion. The top frame portion also includes a left elongated structure and a right elongated structure. A plurality of levers is connected to the left and the right elongated structures of the top frame portion and to the left and the right elongated structures of the bottom frame portion. The adjustable bed base further comprises a backrest motor and a footrest motor positioned at a bottom surface of the top frame portion. The backrest motor and the footrest motor are in electrical communication with a power supply module.

The adjustable bed further comprises a vibration motor located at the bottom surface of the top frame portion. A tilt arm assembly is connected to the bottom surface of the top frame portion. The tilt arm assembly is designed to lift the adjustable bed in the upward direction and in the downward direction. The tilt arm assembly comprises a sliding member, at least one motor claw and at least one bed tilt motor. The sliding member includes a first horizontal rod, a second horizontal rod, a first vertical rod, a second vertical rod, a left roller and a right roller attached thereon. The adjustable bed base includes a remote control. The remote control includes a plurality of control buttons. Each of the plurality of control buttons when pressed generates the at least one operating signal. At least one of the plurality of control buttons is pressed and held until the adjustable bed base tilts to the desired position.

The backrest motor and the footrest motor receive the at least one operating signal and move the plurality of levers connected to the left and the right elongated structures of the top frame portion, lifting the sliding member of the tilt arm assembly to tilt the backrest and the footrest of the top frame portion in the plurality of comfortable positions. When the sliding member moves, the left roller and the right roller slide through the track portion to tilt the backrest and the footrest in the plurality of comfortable positions.

The at least one bed tilt motor is connected to a bed tilt motor first connecting rod and a bed tilt motor second connecting rod. The bed tilt motor first connecting rod is connected to the first and the second vertical rods of the sliding member of the tilt arm assembly. The bed tilt motor second connecting rod is connected to the left and the right elongated structures of the top frame portion. The at least one bed tilt motor receives the at least one operating signal and actuates the sliding member to lift and tilt the top frame portion of the adjustable bed to a desired height level. The adjustable bed further comprises a control box. The control box is electrically connected to the backrest motor, the footrest motor, the at least one bed tilt motor, the vibration motor and the power supply module.

One objective of the invention is to provide an adjustable bed base adaptable to tilt in a number of different, comfortable positions.

A second objective of the invention is to provide an adjustable bed base adaptable to get tilted in a multiple number of positions like backrest tilting, footrest tilting and bed lifting positions.

A third objective of the invention is to provide a tilt arm assembly adaptable to move the adjustable bed base in a desired height level.

A fourth objective of the invention is to provide an adjustable bed base that is easy to operate.

Yet another objective of the invention is to provide an adjustable bed base having an aesthetic and stylish appearance.

These and other advantages and features of the present invention are described with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

DETAILED DESCRIPTION OF THE DRAWINGS

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

Figure 1:
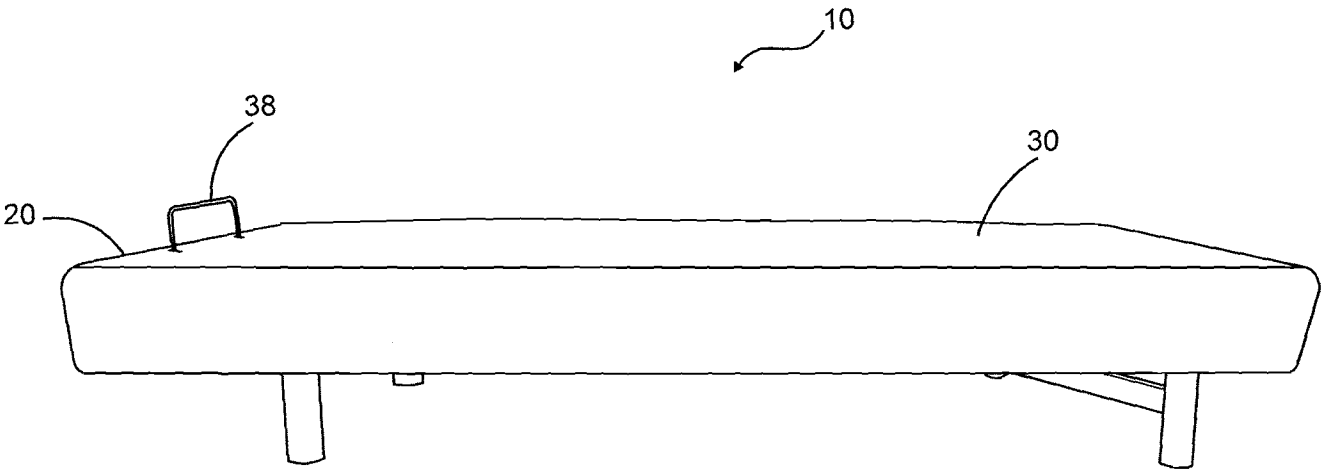
FIG. 1 is a perspective view of the present invention, illustrating an adjustable bed base shown upholstered.

FIG. 1 illustrates an adjustable bed base 10 adaptable to move in a number of different comfortable positions. Referring to FIGS. 1-4, the adjustable bed base 10 generally comprises a bed frame 12 (FIG. 2) having a left side 14, a right side 16, a head end 18, a foot end 20, a top frame portion 22, a bottom frame portion 24, a plurality of bed corners 26, and a deck 28, 30 (shown upholstered).

Figure 2:
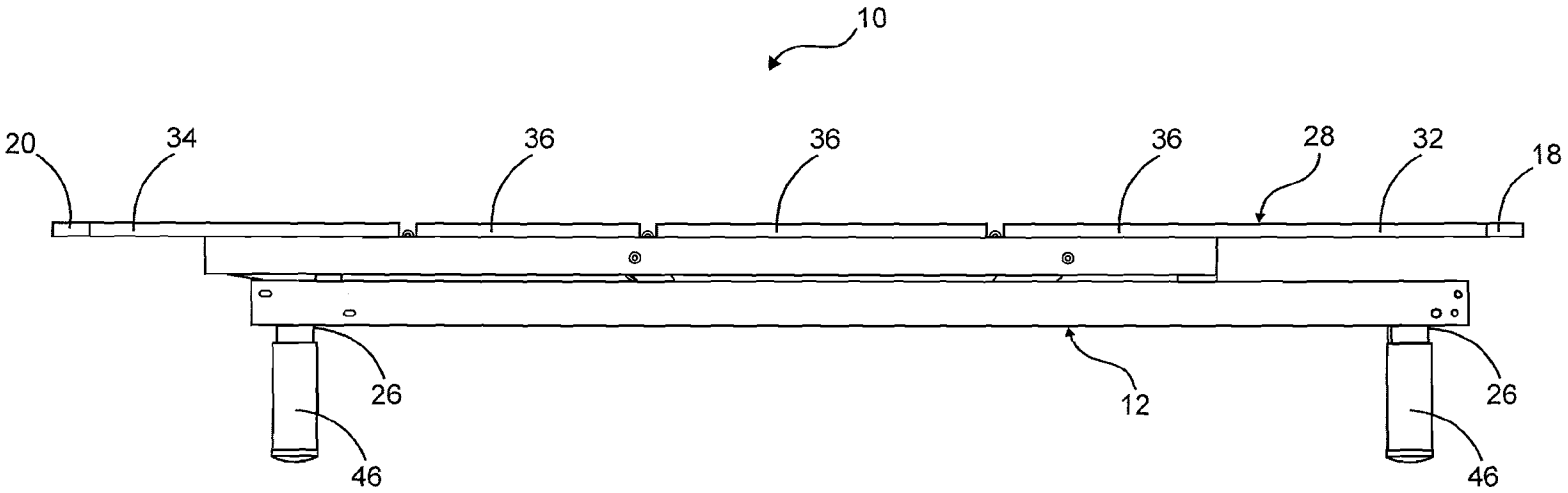
FIG. 2 is a perspective view of the present invention, illustrating a bed frame of the adjustable bed base.
Figure 3:
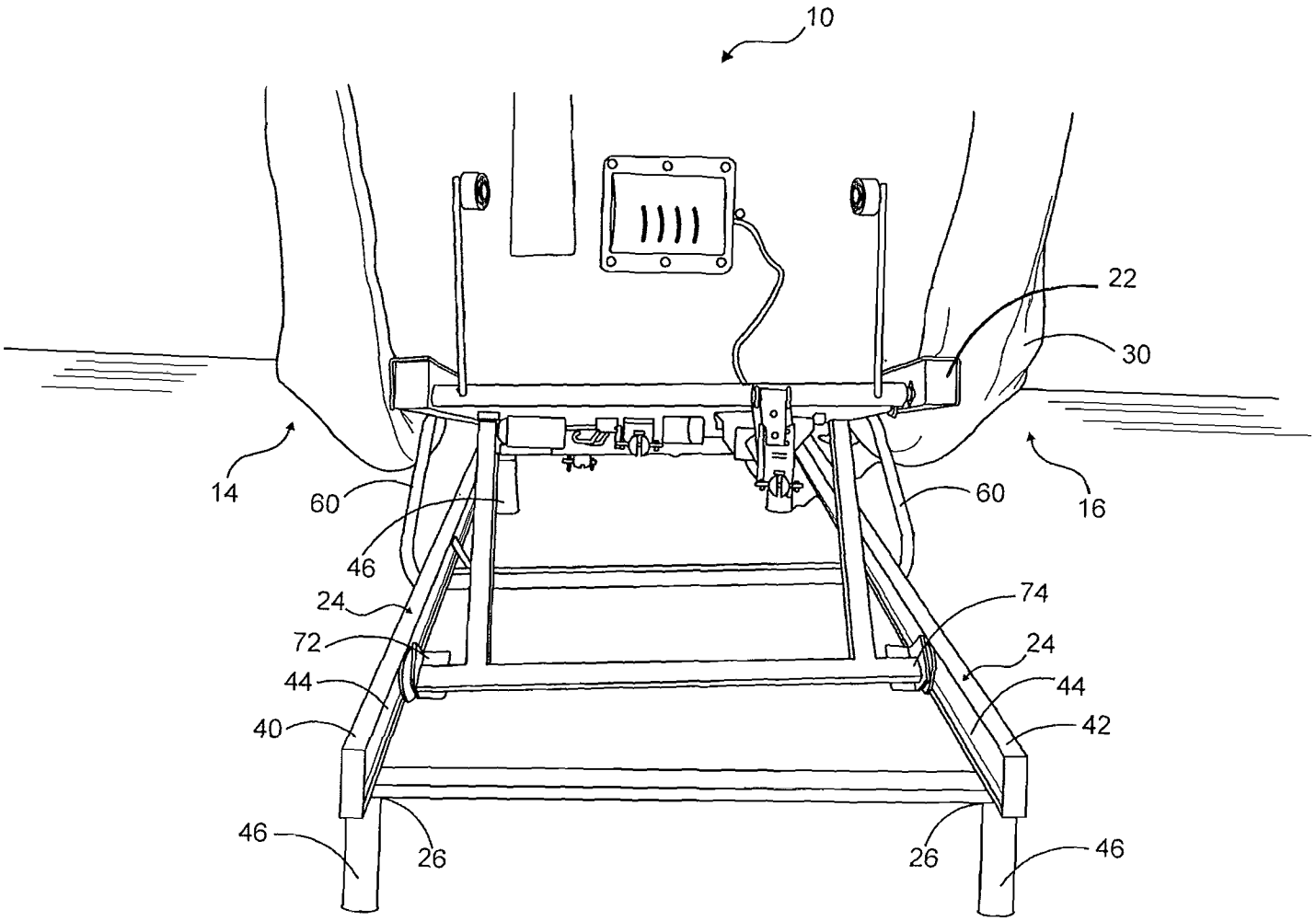
FIG. 3 is a perspective view of the present invention, illustrating a top frame portion and a bottom frame portion of the adjustable bed base.
Figure 4:
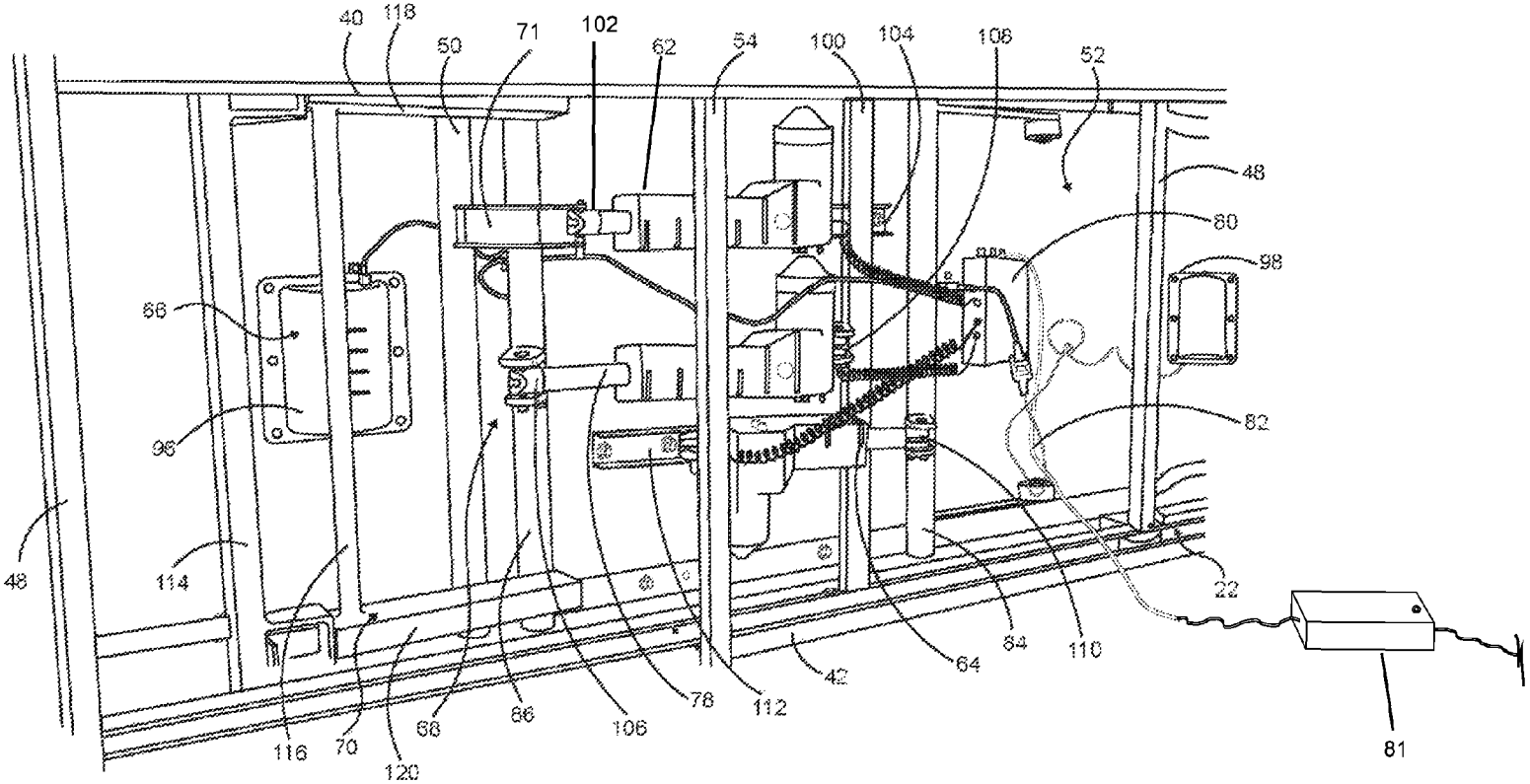
FIG. 4 is a perspective view of the present invention, illustrating a bottom surface of the top frame portion of the adjustable bed base.
Figure 5:
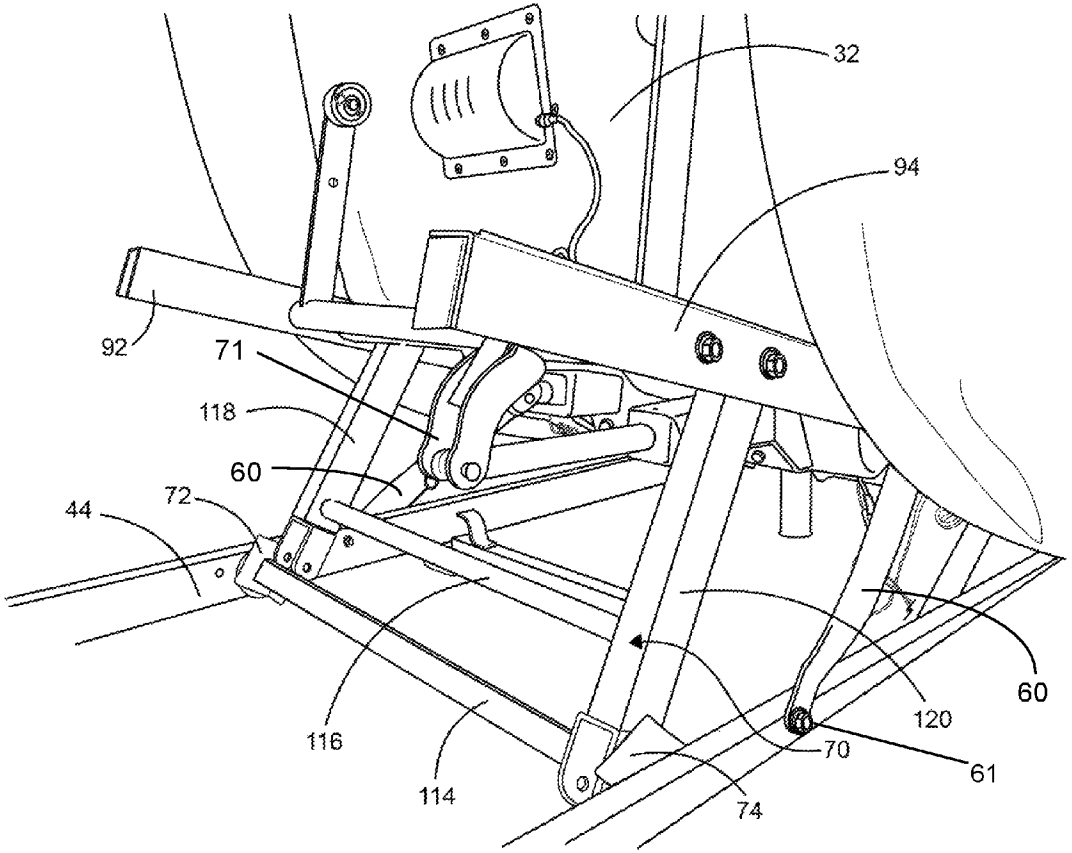
FIG. 5 is a perspective view of the present invention, illustrating a sliding member of the adjustable bed base.

As shown in FIG. 2, a deck 28 is positioned over the bed frame 12 for supporting the mattress (not shown). The deck 28 includes a backrest 32, a footrest 34 and a plurality of middle portions 36. The backrest 32, the footrest 34 and the plurality of middle portions 36 are adaptable to move in different positions. A mattress retainer bar 38 (FIG. 1) is attached to the foot end 20. The mattress retainer bar 38 helps to retain the mattress (not shown) over the bed frame 12 when the adjustable bed base 10 moves in the different comfortable positions. In the preferred embodiment, the mattress retainer bar 38 is electroplated with Chromium element. As illustrated in FIGS. 3 and 4, the bottom frame portion 24 includes a left elongated structure 40 and a right elongated structure 42. A plurality of supporting legs 46 is connected to the left elongated structure 40 and to the right elongated structure 42. In the preferred embodiment, there are four supporting legs 46 and each of these supporting legs 46 is positioned at each of the plurality of bed corners 26. As illustrated in FIG. 5, the top frame portion 22 further includes a top left elongated structure 92 and a top right elongated structure 94.

Referring to FIGS. 3-5, the left and the right elongated structures 40, 42 include a track portion 44. A plurality of levers 60 is connected to the left and the right elongated structures 92, 94 of the top frame portion 22 and to the left and the right elongated structures 40, 42 of the bottom frame portion 24. The plurality of levers 60 allows the adjustable bed base 10 to move in the plurality of comfortable positions allowing the top frame portion 22 to be lifted. Each of the plurality of levers 60 includes a plurality of lever holes 61.

As better shown in FIG. 4, the adjustable bed base 10 further comprises a plurality of motor connecting rods having a backrest motor connecting rod 50, a footrest motor connecting rod 84, a bed tilt motor first connecting rod 86 and a bed tilt motor second connecting rod 100. The plurality of motor connecting rods 50, 84, 86 and 100 is positioned on a bottom surface 52 of the top frame portion 22. A plurality of lateral leg supporting members 48 is connected between the left elongated structure 40 and the right elongated structure 42. The plurality of lateral leg supporting members 48 provides proper support to the plurality of supporting legs 46. A power supply module 81 provides electric power to the adjustable bed base 10. The power supply module 81 includes a power status indicator to indicate the status of power in the power supply module 81.

A tilt arm assembly 68 is connected to the bottom surface 52. The tilt arm assembly 68 is designed to lift the adjustable bed base 10 in the upward direction and in the downward direction. The tilt arm assembly 68 comprises a sliding member 70, at least one motor claw 71 and at least one bed tilt motor 78. The bottom surface 52 of the top frame portion 22 further comprises a backrest motor 62 and a footrest motor 64. The backrest motor 62 is connected to the backrest motor connecting rod 50 and the footrest motor 64 is connected to the footrest motor connecting rod 84. The backrest motor 62 and the footrest motor 64 are in electrical communication with the power supply module 81. The bed tilt motor second connecting rod 100 provides support to the at least one bed tilt motor 78. The at least one bed tilt motor 78 includes a bed tilt motor first end 106 and a bed tilt motor second end 108. The bed tilt motor first end 106 is connected to the bed tilt motor first connecting rod 86 and the bed tilt motor second end 108 is connected to the bed tilt motor second connecting rod 100. The bed tilt motor first connecting rod 86 is connected to the first and the second vertical rods 118, 120 of the sliding member 70 of the tilt arm assembly 68. The bed tilt motor second connecting rod 100 is connected to the left and the right elongated structures 92, 94 of the top frame portion 22. The backrest motor 62 includes a backrest motor first end 102 and a backrest motor second end 104. The backrest motor first end 102 is connected to the motor claw 71. The motor claw 71 is connected to the backrest motor connecting rod 50 and the backrest motor second end 104 is attached to the bottom surface 52. The footrest motor 64 includes a footrest motor first end 110 and a footrest motor second end 112. The footrest motor first end 110 is connected to the footrest motor connecting rod 84 and the footrest motor second end 112 is attached to the bottom surface 52.

The adjustable bed base 10 further comprises a vibration motor 66 located at the bottom surface 52 of the top frame portion 22. The vibration motor 66 is enclosed by a cap 96. The at least one bed tilt motor 78 generates power required to operate the adjustable bed base 10. The at least one bed tilt motor 78 is positioned between the backrest motor 62 and the footrest motor 64 at an optimal orientation and is connected to the at least one bed tilt motor connecting rod 86. The bottom surface 52 of the top portion 22 further includes a plurality of vibration sensors 98. The plurality of vibration sensors 98 includes a backrest vibration sensor (not shown) and a footrest vibration sensor (not shown). With the help of the control box 80, the backrest vibration sensor and the footrest vibration sensor control the intensity of vibrations generated in the backrest motor 62 and in the footrest motor 64 respectively.

The adjustable bed base 10 further comprises a frame reinforcement bar 54 (FIG. 4) positioned at the bottom frame portion 24. The frame reinforcement bar 54 allows the transportation of the adjustable bed base 10 easier and provides strength to the bed frame 12. The backrest motor 62 and the footrest motor 64 receive at least one operating signal transmitted by a remote control 56 (FIG. 6) and move the plurality of levers 60 connected to the top frame portion 22 and the bottom frame portion 24, the sliding member 70 of the tilt arm assembly 68 connected to the top frame portion 22, and the backrest motor connecting rod to tilt the backrest 32 and the footrest 34 respectively in the plurality of comfortable positions. As illustrated in FIGS. 4 and 5, the sliding member 70 includes a first horizontal rod 114, a second horizontal rod 116, a first vertical rod 118, a second vertical rod 120, a left roller 72 and a right roller 74 attached thereon. The left roller 72 is connected to the first vertical rod 118 and the right roller 74 is connected to the second vertical rod 120. The first horizontal rod 114 is attached to the left roller 72 and the right roller 74. When the sliding member 70 moves, the left roller 72 and the right roller 74 slide through the track portion 44 to tilt the backrest 32, the footrest 34 and the deck 28 in the plurality of comfortable positions. The plurality of comfortable positions includes lifting up the backrest 32, lifting down the backrest 32, lifting up the footrest 34, lifting down the footrest 34, bending of the deck 28 and a plurality of bed lifting positions. The top frame portion 22 further includes a top left elongated structure 92 and a top right elongated structure 94.

The at least one bed tilt motor 78 is electrically connected to the power supply module 81. The at least one bed tilt motor 78 receives the at least one operating signal and actuates the sliding member 70 to lift and tilt the top frame portion 22 of the adjustable bed base 10 to a desired height level.

As shown in FIG. 4, the adjustable bed base 10 further comprises a control box 80. The control box 80 includes a plurality of electrical sockets (not shown) and a plurality of cable connections 82. The control box 80 is electrically connected to the backrest motor 62, the footrest motor 64, the at least one bed tilt motor 78, the vibration motor 66 and the power supply module 81 utilizing the plurality of cable connections 82. The control box 80 controls all the three motors 62, 64 and 78. At least one of the plurality of cable connections 82 is connected to the power supply module 81.

Figure 6:
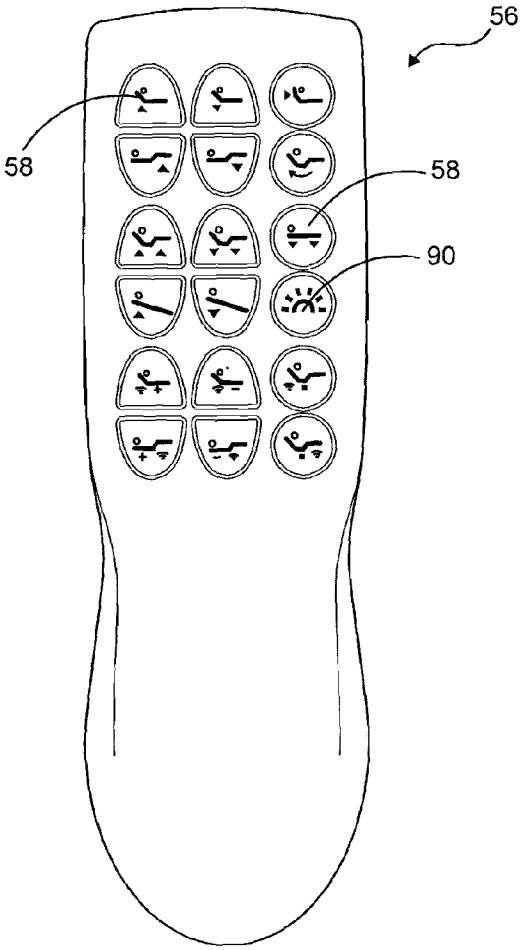
FIG. 6 is a front view of the present invention, illustrating a remote control of the adjustable bed base.

FIG. 6 illustrates the remote control 56 having a plurality of control buttons 58. Each of the plurality of control buttons 58 when pressed generates the at least one operating signal adaptable to tilt the adjustable bed base 10 in the plurality of comfortable positions. Each of the plurality of control buttons 58 on the remote control 56 also activates the backlight function which illuminates the remote control 56. At least one of the plurality of control buttons 58 is pressed and held until the adjustable bed base 10 tilts to the desired position. The remote control 56 further includes a flashlight button 90. When the flashlight button 90 is pressed, light emits from the top of the remote control 56 allowing it to operate as a flashlight. The remote control 56 includes a battery compartment (not shown) to provide power to the remote control 56. The remote control 56 is designed to operate the adjustable bed base 10 in a quick manner.

Figure 7:
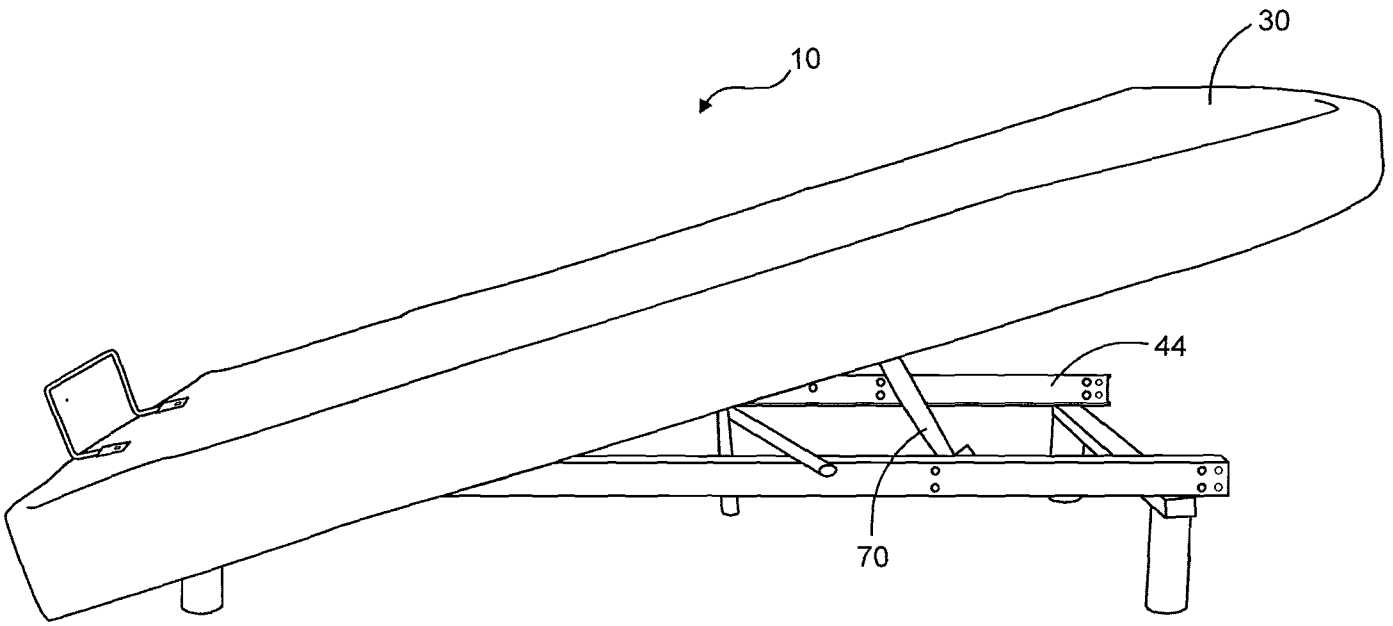
FIG. 7 is a perspective view of the present invention, illustrating the adjustable bed base in a tilted position.

As shown in FIG. 7, the deck 28 is lifted in the upward direction at certain inclination from the ground. In this configuration, the deck 30 is not in a tilted position. Only the top frame portion 22 of the bed frame 12 has tilted at certain inclination. The plurality of levers 60 supports the bed frame 12 to attain this position. This configuration of the adjustable bed base 10 is achieved by pressing and holding the at least one of the control button 58 until the bed frame 12 tilts to the desired height as illustrated in FIG. 7. When the control button 58 is pressed, the at least one operating signal gets generated. The at least one bed tilt motor 78 receives this operating signal and moves the sliding member 70 through the track portion 44. The plurality of levers 60 also moves along with the sliding member 70 and the adjustable bed base 10 gets lifted to the desired height.

Figure 8:
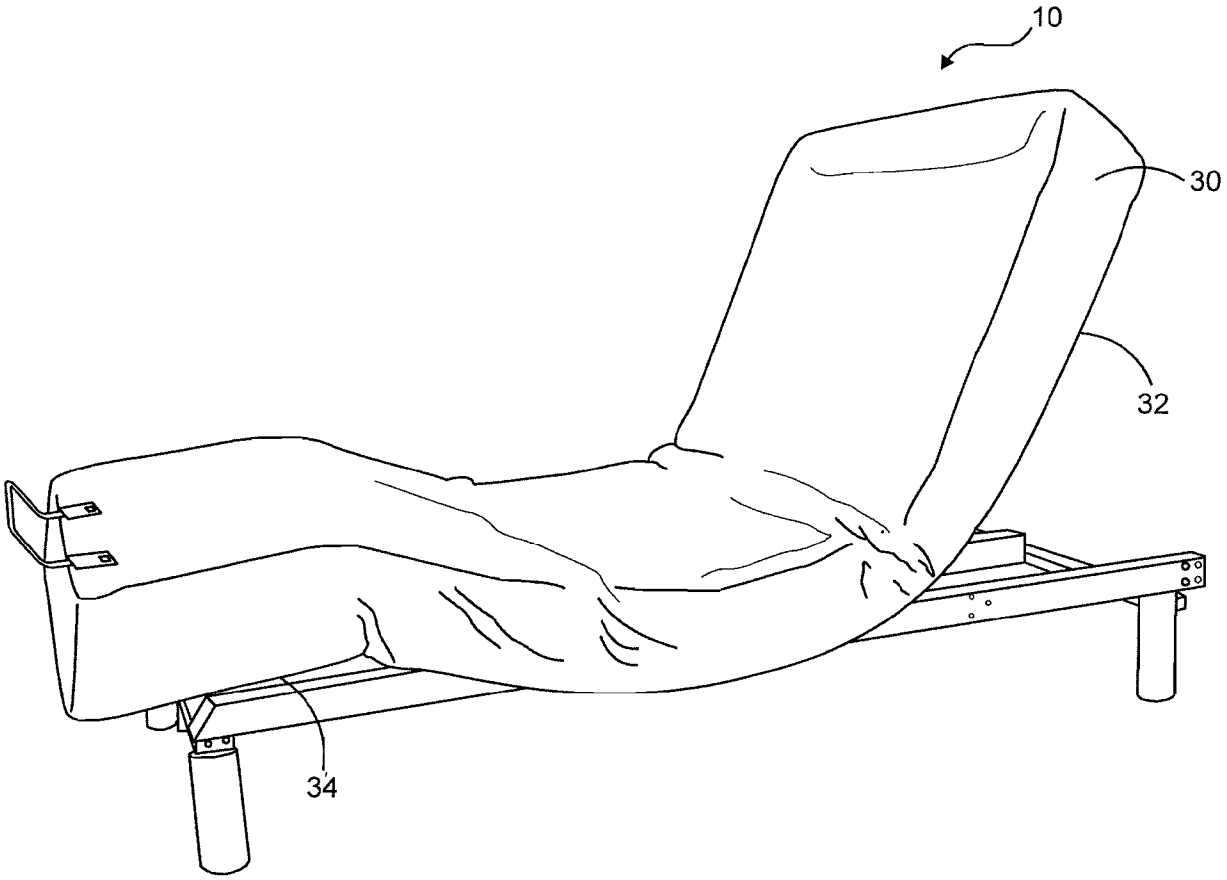
FIG. 8 is a perspective view of the present invention, illustrating the inclined position of the backrest and the footrest of the adjustable bed base.

FIG. 8 shows another configuration of the adjustable bed base 10. In order to achieve this configuration, the at least one of the plurality of control buttons 58 is pressed to generate the operating signal for tilting the backrest 32. The backrest motor 62 receives this operating signal and moves the plurality of levers 60 and the sliding member 70 until the backrest attains the height as illustrated in FIG. 8. Upon lifting the backrest 32, another control button 58 is pressed to tilt the footrest 34. The footrest motor 64 receives the operating signal and lifts the footrest 34 to the desired height. The tilting of the backrest 32 and the footrest 34 bends the deck 30 as illustrated in FIG. 8.

Figure 9:
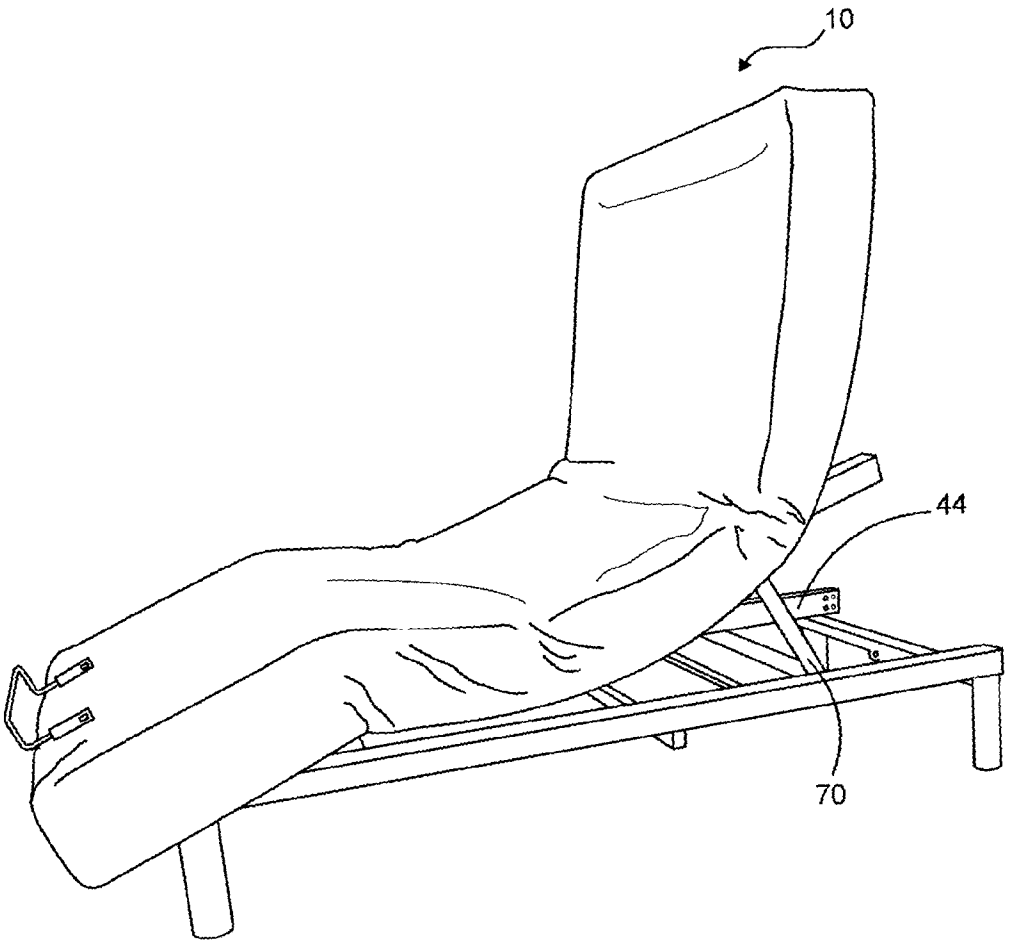
FIG. 9 is a perspective view of the present invention, illustrating the inclined position of the backrest, the footrest and the tilted position of the adjustable bed frame.

Referring to FIG. 9, the adjustable bed base 10 shown in FIG. 8 has been tilted in the upward direction. The remote control 56 generates the operating signal to lift the adjustable bed base 10 in the upward direction. When the at least one bed tilt motor 78 receives this operating signal, the sliding member 70 slides through the track portion 44 until the desired height has attained.

The adjustable bed base 10 can be customized to hold different sized mattresses (not shown) like king size, queen size and twin size. Depending on the size of the adjustable bed base 10 and the user's requirements, the adjustable bed base 10 can hold any number of mattresses (not shown). If the mattress (not shown) is twin sized, only one bed tilt motor 78 is required. If the mattress (not shown) is full or queen sized then more power is required to operate the adjustable bed base 10 and hence there will be two bed tilt motors 78.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto.

What is claimed is:

1. An adjustable bed base, comprising:

a bed frame having a left side, a right side, a head end, a foot end, a top frame portion, a bottom frame portion and a plurality of bed corners;

a deck positioned over the bed frame for securely holding a mattress, the deck includes a backrest, a footrest and a plurality of middle portions;

a mattress retainer bar attached at the foot end to retain the mattress on the bed frame;

a left elongated structure positioned at the bottom frame portion;

a right elongated structure positioned at the bottom frame portion, the left elongated structure and the right elongated structure includes a track portion;

a plurality of supporting legs connected to the left elongated structure and to the right elongated structure;

a plurality of lateral leg supporting members connected between the left elongated structure and the right elongated structure;

a plurality of motor connecting rods located at a bottom surface of the top frame portion;

a frame reinforcement bar positioned at the bottom frame portion;

a power supply module for providing electric power to the adjustable bed base;

a remote control designed to transmit at least one operating signal adaptable to tilt the adjustable bed base in a plurality of comfortable positions, the remote control includes a plurality of control buttons;

a plurality of levers connected to the top frame portion and to the bottom frame portion, the plurality of levers allows the adjustable bed base to move in the plurality of comfortable positions;

a backrest motor positioned at the bottom surface of the top frame portion, the backrest motor receives the at least one operating signal transmitted by the remote control and moves the plurality of levers to tilt the backrest in the plurality of comfortable positions;

a footrest motor located at the bottom surface of the top frame portion, the footrest motor receives the at least one operating signal transmitted by the remote control and moves the plurality of levers to tilt the footrest in the plurality of comfortable positions;

a vibration motor located at the bottom surface of the top frame portion;

a plurality of vibration sensors located at the bottom surface of the top frame portion;

a tilt arm assembly connected to the bottom surface, the tilt arm assembly, comprising:

a sliding member having a first horizontal rod, a second horizontal rod, a first vertical rod, a second vertical rod, a left roller and a right roller attached thereon, the sliding member being actuated by the movement of the plurality of levers connected to the top frame portion by the backrest motor and the footrest motor and slides through the track portion of the left and the right elongated structures thereby tilting the backrest and the footrest in the plurality of comfortable positions;

at least one motor claw having a plurality of motor claw holes for connecting the backrest motor; and at least one bed tilt motor electrically connected to the power supply module, the at least one bed tilt motor receives the at least one operating signal and moves the sliding member and the plurality of levers to tilt the adjustable bed base to a desired height level; and a control box electrically connected to the power supply module and located at the bottom surface of the top frame portion;

whereby the backrest motor, the footrest motor and the at least one bed tilt motor receive the at least one operating signal and tilt the adjustable bed base to the desired position.

2. The adjustable bed base of claim 1 wherein the remote control includes a plurality of control buttons for tilting the adjustable bed base to at least one of the plurality of comfortable positions.

3. The adjustable bed base of claim 1 wherein the plurality of comfortable positions includes lifting up the backrest, lifting down the backrest, lifting up the footrest, lifting down the footrest and a plurality of bed tilting positions.

4. The adjustable bed base of claim 1 wherein the frame reinforcement bar allows the transportation of the adjustable bed base easier and provides strength to the bed frame.

5. The adjustable bed base of claim 1 wherein each of the plurality of levers includes a plurality of lever holes.

6. The adjustable bed base of claim 1 wherein each of the plurality of control buttons when pressed generates the at least one operating signal.

7. The adjustable bed base of claim 1 wherein the mattress retainer bar secures the mattress against the bed frame when the adjustable bed base moves in the plurality of comfortable positions.

8. The adjustable bed base of claim 1 wherein the power supply module includes a power status indicator to indicate the status of power in the power supply module.

9. The adjustable bed base of claim 1 wherein the remote control includes a battery compartment to provide power to the remote control.

10. The adjustable bed base of claim 1 wherein the backrest motor and the footrest motor are in electrical communication with the power supply module.

11. The adjustable bed base of claim 1 wherein the control box includes a plurality of electrical sockets and a plurality of cable connections.

12. The adjustable bed base of claim 1 wherein the control box is connected to the backrest motor, to the footrest motor and to the at least one bed tilt motor.

13. The adjustable bed base of claim 1 wherein the plurality of vibration sensors includes a backrest vibration sensor and a footrest vibration sensor.

14. The adjustable bed base of claim 13 wherein the backrest vibration sensor and the footrest vibration sensor control the intensity of vibrations generated in the backrest motor and in the footrest motor respectively.

15. The adjustable bed base of claim 1 wherein the left roller and the right roller are connected to the first horizontal rod.

16. The adjustable bed base of claim 1 wherein the plurality of motor connecting rods includes a backrest motor connecting rod, a footrest motor connecting rod, a bed tilt motor first connecting rod connected to the sliding member and a bed tilt motor second connecting rod connected to the left and the right elongated structures of the top frame portion.

17. The adjustable bed base of claim 16 wherein the bed tilt motor second connecting rod provides support to the at least one bed tilt motor.

18. The adjustable bed base of claim 16 wherein the at least one bed tilt motor includes a bed tilt motor first end and a bed tilt motor second end.

19. The adjustable bed base of claim 18 wherein the bed tilt motor first end is connected to the bed tilt motor first connecting rod and the bed tilt motor second end is connected to the bed tilt motor second connecting rod.

20. The adjustable bed base of claim 16 wherein the backrest motor includes a backrest motor first end connected to the tilt arm assembly via the motor claw and a backrest motor second end connected to the bed tilt motor second connecting rod.

21. The adjustable bed base of claim 1 wherein the footrest motor includes a footrest motor first end and a footrest motor second end.

22. An adjustable bed base, comprising:

a bed frame having a left side, a right side, a head end, a foot end, a top frame portion, a bottom frame portion and a plurality of bed corners;

a deck positioned over the bed frame for securely holding a mattress, the deck includes a backrest, a footrest and a plurality of middle portions;

a mattress retainer bar attached at the foot end to retain the mattress on the bed frame;

a left elongated structure positioned at the bottom frame portion;

a right elongated structure positioned at the bottom frame portion, the left elongated structure and the right elongated structure includes a track portion;

a plurality of supporting legs connected to the left elongated structure and to the right elongated structure;

a plurality of lateral leg supporting members connected between the left elongated structure and the right elongated structure;

a plurality of motor connecting rods located at a bottom surface of the top frame portion;

a frame reinforcement bar positioned at the bottom frame portion;

a power supply module for providing electric power to the adjustable bed base;

a remote control designed to transmit at least one operating signal adaptable to tilt the adjustable bed base in a plurality of comfortable positions, the remote control includes a plurality of control buttons, each of the plurality of control buttons when pressed generates the at least one operating signal;

a plurality of levers connected to the top frame portion and to the bottom frame portion, the plurality of levers allows the adjustable bed base to move in the plurality of comfortable positions, each of the plurality of levers includes a plurality of lever holes;

a backrest motor positioned at the bottom surface of the top frame portion, the backrest motor receives the at least one operating signal transmitted by the remote control and moves the plurality of levers to tilt the backrest in the plurality of comfortable positions;

a footrest motor located at the bottom surface of the top frame portion, the footrest motor receives the at least one operating signal transmitted by the remote control and moves the plurality of levers to tilt the footrest in the plurality of comfortable positions;

a vibration motor located at the bottom surface of the top frame portion;

a tilt arm assembly connected to the bottom surface, the tilt arm assembly, comprising:

a sliding member having a first horizontal rod, a second horizontal rod, a first vertical rod, a second vertical rod, a left roller and a right roller attached thereon, the sliding member being actuated by the movement of the plurality of levers connected to the top frame portion by the backrest motor and the footrest motor and slides through the track portion of the left and the right elongated structures thereby tilting the backrest and the footrest in the plurality of comfortable positions;

at least one motor claw having a plurality of motor claw holes for connecting the backrest motor; and at least one bed tilt motor electrically connected to the power supply module, the at least one bed tilt motor receives the at least one operating signal and moves the sliding member and the plurality of levers to tilt the adjustable bed base to a desired height level; and a control box electrically connected to the power supply module and located at the bottom surface of the top frame portion;

whereby the backrest motor, the footrest motor and the at least one bed tilt motor receive the at least one operating signal and tilt the adjustable bed base to the desired position.

23. The adjustable bed base of claim 22 wherein the remote control includes a plurality of control buttons for tilting the adjustable bed base to at least one of the plurality of comfortable positions.

24. The adjustable bed base of claim 22 wherein the plurality of comfortable positions includes lifting up the backrest, lifting down the backrest, lifting up the footrest, lifting down the footrest and a plurality of bed tilting positions.

25. The adjustable bed base of claim 22 wherein the frame reinforcement bar allows the transportation of the adjustable bed base easier and provides strength to the bed frame.

26. The adjustable bed base of claim 22 wherein the mattress retainer bar secures the mattress against the bed frame when the adjustable bed base moves in the plurality of comfortable positions.

27. The adjustable bed base of claim 22 wherein the power supply module includes a power status indicator to indicate the status of power in the power supply module.

28. The adjustable bed base of claim 22 wherein the remote control includes a battery compartment to provide power to the remote control.

29. The adjustable bed base of claim 22 wherein the backrest motor and the footrest motor are in electrical communication with the power supply module.

30. The adjustable bed base of claim 22 wherein the control box includes a plurality of electrical sockets and a plurality of cable connections.

31. The adjustable bed base of claim 22 wherein the plurality of vibration sensors includes a backrest vibration sensor and a footrest vibration sensor.

32. The adjustable bed base of claim 31 wherein the backrest vibration sensor and the footrest vibration sensor control the intensity of vibrations generated in the backrest motor and in the footrest motor respectively.

33. The adjustable bed base of claim 22 wherein the control box is connected to the backrest motor, to the footrest motor and to the at least one bed tilt motor.

34. The adjustable bed base of claim 22 wherein the left roller and the right roller are connected to the first horizontal rod.

35. The adjustable bed base of claim 22 wherein the plurality of motor connecting rods includes a backrest motor connecting rod, a footrest motor connecting rod, a bed tilt motor first connecting rod connected to the sliding member and a bed tilt motor second connecting rod connected to the left and the right elongated structures of the top frame portion.

36. The adjustable bed base of claim 35 wherein the bed tilt motor second connecting rod provides support to the at least one bed tilt motor.

37. The adjustable bed base of claim 35 wherein the at least one bed tilt motor includes a bed tilt motor first end and a bed tilt motor second end.

38. The adjustable bed base of claim 37 wherein the bed tilt motor first end is connected to the bed tilt motor first connecting rod and the bed tilt motor second end is connected to the bed tilt motor second connecting rod.

39. The adjustable bed base of claim 35 wherein the backrest motor includes a backrest motor first end connected to the tilt arm assembly via the motor claw and a backrest motor second end connected to the bed tilt motor second connecting rod.

40. The adjustable bed base of claim 22 wherein the footrest motor includes a footrest motor first end and a footrest motor second end.

41. An adjustable bed base, comprising:

a bed frame having a left side, a right side, a head end, a foot end, a top frame portion, a bottom frame portion and a plurality of bed corners;

a deck positioned over the bed frame for securely holding a mattress, the deck includes a backrest, a footrest and a plurality of middle portions;

a mattress retainer bar attached at the foot end to retain the mattress on the bed frame;

a left elongated structure positioned at the bottom frame portion;

a right elongated structure positioned at the bottom frame portion, the left elongated structure and the right elongated structure includes a track portion;

a plurality of supporting legs, each of the plurality of supporting legs being connected to the left elongated structure and to the right elongated structure;

a plurality of lateral leg supporting members connected between the left elongated structure and the right elongated structure;

a frame reinforcement bar positioned at the bottom frame portion to provide strength to the bed frame;

a plurality of motor connecting rods located at a bottom surface of the top frame portion;

a power supply module for providing electric power to the adjustable bed base, the power supply module includes a power status indicator;

a remote control designed to transmit at least one operating signal adaptable to tilt the adjustable bed base in a plurality of comfortable positions, the remote control includes a plurality of control buttons, each of the plurality of control buttons when pressed generates the at least one operating signal;

a plurality of levers connected to the top frame portion and to the bottom frame portion, the plurality of levers enables the adjustable bed base to move in the plurality of comfortable positions, each of the plurality of levers includes a plurality of lever holes;

a backrest motor positioned at the bottom surface of the top frame portion, the backrest motor receives the at least one operating signal transmitted by the remote control and moves the plurality of levers to tilt the backrest in the plurality of comfortable positions;

a footrest motor located at the bottom surface of the top frame portion, the footrest motor receives the at least one operating signal transmitted by the remote control and moves the plurality of levers to tilt the footrest in the plurality of comfortable positions;

a vibration motor located at the bottom surface of the top frame portion;

a tilt arm assembly connected to the bottom surface, the tilt arm assembly, comprising:

a sliding member having a first horizontal rod, a second horizontal rod, a first vertical rod, a second vertical rod, a left roller and a right roller attached thereon, the sliding member being actuated by the movement of the plurality of levers connected to the top frame portion by the backrest motor and the footrest motor and slides through the track portion of the left and the right elongated structures thereby tilting the backrest and the footrest in the plurality of comfortable positions;

at least one motor claw having a plurality of motor claw holes for connecting the backrest motor; and at least one bed tilt motor electrically connected to the power supply module, the at least one bed tilt motor receives the at least one operating signal and moves the sliding member to tilt the adjustable bed base to a desired height level; and a control box electrically connected to the power supply module and located at the bottom surface of the top frame portion;

whereby the backrest motor, the footrest motor and the at least one bed tilt motor receive the at least one operating signal and tilt the adjustable bed base to the desired position.

42. The adjustable bed base of claim 41 wherein the remote control includes a plurality of control buttons for tilting the adjustable bed base to at least one of the plurality of comfortable positions.

43. The adjustable bed base of claim 41 wherein the plurality of comfortable positions includes lifting up the backrest, lifting down the backrest, lifting up the footrest, lifting down the footrest and a plurality of bed tilting positions.

44. The adjustable bed base of claim 41 wherein the frame reinforcement bar allows the transportation of the adjustable bed base easier.

45. The adjustable bed base of claim 41 wherein the mattress retainer bar secures the mattress over the bed frame when the adjustable bed base moves in the plurality of comfortable positions.

46. The adjustable bed base of claim 41 wherein the power supply module includes a power status indicator to indicate the status of power in the power supply module.

47. The adjustable bed base of claim 41 wherein the remote control includes a battery compartment to provide power to the remote control.

48. The adjustable bed base of claim 41 wherein the backrest motor and the footrest motor are in electrical communication with the power supply module.

49. The adjustable bed base of claim 41 wherein the control box includes a plurality of electrical sockets and a plurality of cable connections.

50. The adjustable bed base of claim 41 wherein the control box is connected to the backrest motor, to the footrest motor and to the at least one bed tilt motor.

51. The adjustable bed base of claim 41 wherein the plurality of vibration sensors includes a backrest vibration sensor and a footrest vibration sensor.

52. The adjustable bed base of claim 51 wherein the backrest vibration sensor and the footrest vibration sensor control the intensity of vibrations generated in the backrest motor and in the footrest motor respectively.

53. The adjustable bed base of claim 41 wherein the left roller and the right roller are connected to the first horizontal rod.

54. The adjustable bed base of claim 41 wherein the plurality of motor connecting rods includes a backrest motor connecting rod, a footrest motor connecting rod, a bed tilt motor first connecting rod connected to the sliding member and a bed tilt motor second connecting rod connected to the left and the right elongated structures of the top frame portion.

55. The adjustable bed base of claim 54 wherein the bed tilt motor second connecting rod provides support to the at least one bed tilt motor.

56. The adjustable bed base of claim 54 wherein the at least one bed tilt motor includes a bed tilt motor first end and a bed tilt motor second end.

57. The adjustable bed base of claim 56 wherein the bed tilt motor first end is connected to the bed tilt motor first connecting rod and the bed tilt motor second end is connected to the bed tilt motor second connecting rod.

58. The adjustable bed base of claim 54 wherein the backrest motor includes a backrest motor first end connected to the tilt arm assembly via the motor claw and a backrest motor second end connected to the bed tilt motor second connecting rod.

59. The adjustable bed base of claim 41 wherein the footrest motor includes a footrest motor first end and a footrest motor second end.

* * * * *